US006854609B1

(12) United States Patent
Hettinger

(10) Patent No.: US 6,854,609 B1
(45) Date of Patent: Feb. 15, 2005

(54) HANGING FRUIT TREE CONSTRUCTION

(76) Inventor: Kevin D. Hettinger, 7012 Brighton Oaks Blvd., Navarre, FL (US) 32566

( * ) Notice: Subject to any disclaimer, the term of this patent is extended or adjusted under 35 U.S.C. 154(b) by 165 days.

(21) Appl. No.: 10/378,345

(22) Filed: Mar. 3, 2003

(51) Int. Cl.[7] ..... A47G 29/00
(52) U.S. Cl. ..... 211/85.4; 248/317
(58) Field of Search ..... 211/85.4, 205, 211/196, 189; 24/299, 265 EC, 343; 248/317, 316.5, 316.7, 339, 229.23, 229.13, 686

(56) References Cited

U.S. PATENT DOCUMENTS

| | | | | | |
|---|---|---|---|---|---|
| 980,162 | A | * | 12/1910 | Meyer | 248/229.23 |
| 1,078,804 | A | * | 11/1913 | Royse | 211/85.4 |
| 1,089,290 | A | * | 3/1914 | Thompson | 248/165 |
| 2,038,903 | A | * | 4/1936 | Rakatzky | 211/96 |
| 2,066,478 | A | * | 1/1937 | Lewin, Jr. | 211/206 |
| 3,041,696 | A | * | 7/1962 | Ferri, Jr. | 24/566 |
| 3,131,449 | A | * | 5/1964 | Iida | 24/334 |
| 3,310,180 | A | * | 3/1967 | Neagle | 211/205 |
| 5,318,189 | A | * | 6/1994 | Lee | 211/205 |
| 6,568,546 | B1 | * | 5/2003 | Huang | 211/205 |

OTHER PUBLICATIONS

U.S. Appl. No. 2002/0144961A1 to McNab, Publication date Oct. 10, 2002.*
U.S. Appl. No. 2003/0006204A1 to Baker, Publication date Jan. 9, 2003.*

* cited by examiner

*Primary Examiner*—Ramon O Ramirez
(74) *Attorney, Agent, or Firm*—Sturm & Fix LLP

(57) ABSTRACT

A hanging fruit tree construction (10) for suspending individual articles of fruit (100) from their respective stems (101) wherein, the construction (10) includes a circular base (21) that supports an elongated shaft member (30), the upper portion of which is provided with a plurality of recesses (32) which are dimensioned to receive the inboard ends of a plurality of dowels (40) (40') the outer portions of which are adapted to releasably engage at least one spring clip member (50) the jaw elements (51) (52) of which are adapted to releasably engage the stem portion (101) of an article of fruit.

11 Claims, 1 Drawing Sheet

HANGING FRUIT TREE CONSTRUCTION

BACKGROUND OF THE INVENTION CROSS REFERENCE TO RELATED APPLICATIONS

Not applicable.

1. Field of the Invention

The present invention relates to the field of devices for suspending and displaying fruit in general and in particular to a display stand for suspending fruit from their stem portions.

2. Description of Related Art

As can be seen by reference to the following U.S. Pat. Nos. 977,071; 1,754,998; 1,078,804; 6,416,026; and, 5,771,790 the prior art is replete with myriad and diverse support and display devices for fruit.

While all of the aforementioned prior art constructions are more than adequate for the basic purpose and function for which they have been specifically designed, they are uniformly deficient with respect to their failure to provide a simple, efficient, and practical fruit tree construction wherein, the limbs of the tree are adapted to suspend fruit both in bunches and on an individual basis from their respective stem portions.

Unfortunately, none of the aforementioned prior art constructions has made any provision for suspended individual items of fruit such as apples, pears, grapes, bananas, cherries, etc., from their stems on an individual basis to produce both an aesthetically pleasing as well as, a more naturally appearing arrangement.

As a consequence of the foregoing situation, there has existed a longstanding need among fruit eaters for a new and improved hanging fruit tree construction that supports and suspends a plurality of diverse fruits on an individual basis from the simulated limbs of an artificial tree; and, the provision of such a construction is the stated objective of the present invention.

BRIEF SUMMARY OF THE INVENTION

Briefly stated, the fruit tree construction that forms the basis of the present invention comprises in general a base unit, a shaft unit, a plurality of limb units and a plurality of fruit stem engaging units which cooperate with one another to suspend individual fruits in a natural fashion from a simulated tree configuration.

As will be explained in greater detail further on in the specification, the base unit comprises a generally truncated cylindrical base member including a generally circular base provided with raised sidewalls wherein, the shaft unit includes an elongated shaft member having a lower end adapted to be affixed to the center of the circular base and having an upper end provided with a plurality of recesses.

In addition, each of the recesses in the upper portion of the shaft member is dimensioned to receive one of the plurality of limb units wherein each limb unit includes a dowel member provided with one or more eyelets.

Furthermore, each of the plurality of fruit stem engaging units comprises a spring clip member having a pair of spring loaded clip arms adapted to engage the stem portion of fruit wherein, one of the clip arms is provided with a hook portion adapted to releasably engage a selected eyelet on a selected one of the dowel members.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
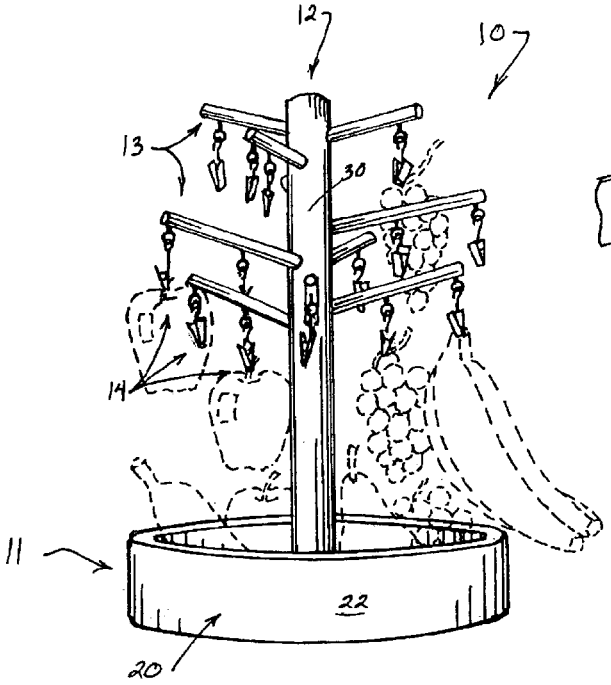
FIG. 1 is a perspective view of the hanging fruit tree construction that forms the basis of the present invention.

As can be seen by reference to the drawings, and in particular to FIG. 1, the hanging fruit tree construction that forms the basis of the present invention is designated generally by the reference number 10. The construction 10 comprises in general: a base unit 11, a shaft unit 12, a plurality of limb units 13, and a plurality of fruit stem engaging units 14. These units will now be described in seriatim fashion.

As can best be seen by reference to FIGS. 1 and 3, the base unit 11 comprises a generally truncated cylindrical base member 20 having a circular base 21 provided with raised sidewalls 22 to define a shallow receptacle for receiving a quantity of fruit wherein, the circular base 21 is further provided with a central aperture 23 dimensioned to receive a conventional fastener 24 the purpose and function of which will be described presently.

Still referring to FIGS. 1 and 3, it can be seen that the shaft unit 12 comprises an elongated shaft member 30 the lower end of which is provided with a threaded aperture 31 adapted to receive said conventional fastener 24 and, the upper portion of which is provided with a plurality of vertically offset and staggered angular recesses 32 the purpose and function of which will be described presently.

Figure 3:
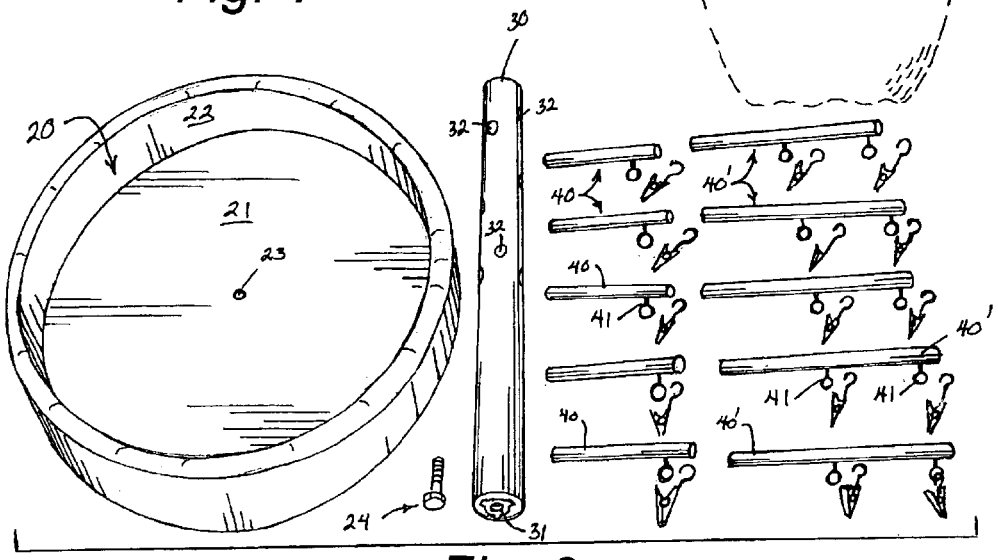

Turning now to FIG. 3, it can be seen that the plurality of limb units 13 comprises a first plurality of short dowels 40 and a second plurality of elongated dowels 40' wherein, the first plurality of short dowels 40 is provided with a single downwardly depending eyelet 41 and the second plurality of elongated dowels 40' is provided with a plurality of downwardly depending eyelets 41 and wherein, all of the dowels 40 40' have an inboard end dimensioned to be received in a selected one of the recesses 32 formed in the shaft member 30.

Figure 2:
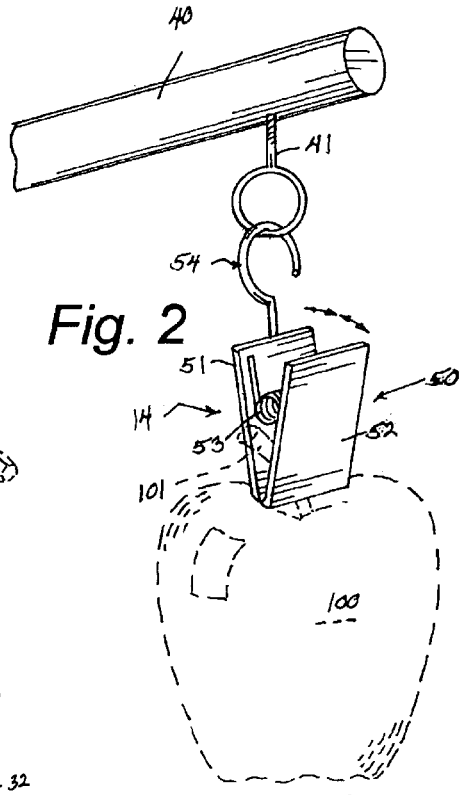
FIG. 2 is an isolated detail view of a single stemmed fruit suspended from one of the limb units; and, FIG. 3 is a disassembled view of all of the structural components that comprise the hanging fruit tree construction.

Furthermore, as can best be seen by reference to FIGS. 2 and 3, each of the plurality of stem engaging units 14 comprises a spring clip member 50 including a pair of spring clip jaws 51 52 pivotally associated with one another by a spring element 53 wherein, one of the spring clip jaws 51 is further provided with a hook element 54 that is adapted to releasably engage a selected eyelet 41 after the spring clip jaws 51 52 have captively engaged the stem portion 101 of an article of fruit 100.

At this juncture, it should be noted that for the purposes of this invention, the eyelets 41 and the hook elements 54 may be interchangeable with one another wherein, the dowels 40 40' are provided with hook elements 54 and the spring clip members 50 are provided with looped eyelets 41.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I Claim:

1. A hanging fruit tree construction comprising a base unit including a circular base a shaft unit including an elongated shaft member having a lower end adapted to be centrally affixed to the circular base and having an upper end provided with a plurality of vertically staggered recesses a plurality of limb units including a plurality of dowels having inboard ends adapted to be captively received in said plurality of recesses and further having outboard portions; and, a plurality of fruit stem engaging units operatively associated with the outboard portions of said plurality of dowels wherein, each fruit stem engaging unit includes a spring clip member wherein, each of the plurality of dowels is provided with a selected one among an eyelet and a hook element, and each of the plurality of spring clip members is provided with the non-selected one among the eyelet and the hook element.

2. The construction as in claim 1; wherein, said spring clip member includes a pair of relatively movable spring clip jaws.

3. The construction as in claim 2; wherein, said spring clip jaws are pivotally associated with a spring element.

4. The construction as in claim 1; wherein, the base unit further includes raised sidewalls surrounding said circular base.

5. The construction as in claim 2; wherein, the base unit further includes raised sidewalls surrounding said circular base.

6. The construction as in claim 3; wherein, the base unit further includes raised sidewalls surrounding said circular base.

7. The construction as in claim 1; wherein, said plurality of dowels includes a first plurality of short dowels and a second plurality of elongated dowels.

8. The construction as in claim 7; wherein, said first plurality of short dowels is each associated with at least one spring clip member.

9. The construction as in claim 7; wherein, said second plurality of elongated dowels is adapted to be associated with at least a pair of spring clip members.

10. The construction as in claim 3; wherein, said second plurality of elongated dowels is adapted to be associated with at least a pair of spring dip members.

11. A hanging fruit tree construction comprising a base unit including a circular base a shaft unit including an elongated shaft member having a lower end adapted to be affixed to the base and having an upper end a plurality of limb units including a plurality of dowels having inboard ends adapted to be connected to said shaft member and further having outboard portions; and, a plurality of fruit stem engaging units operatively associated with the outboard portions of said plurality of dowels wherein, each of the plurality of dowels is provided with a selected one among an eyelet and a hook element, and each of the plurality of spring clip members is provided with the non-selected one among the eyelet and the hook element.

* * * * *